US006592194B2

(12) United States Patent
Lininger et al.

(10) Patent No.: US 6,592,194 B2
(45) Date of Patent: Jul. 15, 2003

(54) OFFICE FURNITURE SYSTEM

(76) Inventors: Robert R. Lininger, 710 N. Paulina Ave., Redondo Beach, CA (US) 90277; Julian Vochelli, 19322 Pitcairn La., Huntington Beach, CA (US) 92646; Michael G. Haber, 4411 Pacific Coast Hwy., Apt. G-107, Torrance, CA (US) 90505; Timothy Skinner, 1399 Rosebud Rd., Quitman, AR (US) 72131

( * ) Notice: Subject to any disclaimer, the term of this patent is extended or adjusted under 35 U.S.C. 154(b) by 5 days.

(21) Appl. No.: 09/736,652

(22) Filed: Dec. 13, 2000

(65) Prior Publication Data

US 2001/0017009 A1 Aug. 30, 2001

Related U.S. Application Data

(63) Continuation-in-part of application No. 09/165,409, filed on Oct. 2, 1998, now abandoned.

(51) Int. Cl.[7] ..... A47B 43/00

(52) U.S. Cl. ..... 312/257.1; 312/265.5; 312/265.6; 52/282.2

(58) Field of Search ..... 312/223.6, 223.3, 312/265.6, 265.5, 263; 108/50.01, 50.02; 52/36.1, 36.5, 36.6, 282.2

(56) References Cited

U.S. PATENT DOCUMENTS 3,370,389 A * 2/1968 Macaluso ..... 52/282.2 X
3,451,183 A * 6/1969 Lespagnol et al. ..... 52/282.2 X
3,513,606 A * 5/1970 Jones ..... 52/239
4,388,786 A * 6/1983 Gassler ..... 52/282.2
4,458,461 A * 7/1984 Holley ..... 52/239
4,652,170 A * 3/1987 Lew ..... 52/282.2 X
4,768,845 A * 9/1988 Yeh ..... 312/263 X
5,067,294 A * 11/1991 McGowan ..... 52/282.2 X
5,477,594 A * 12/1995 LePage ..... 312/111 X
5,647,650 A * 7/1997 Daugherty et al. ..... 312/265.1
5,833,332 A * 11/1998 Marshall et al. ..... 52/36.1 X
5,864,997 A * 2/1999 Kelley ..... 52/282.2
6,185,887 B1 * 2/2001 Strassle ..... 52/282.2

FOREIGN PATENT DOCUMENTS

DE 2817518 * 10/1979 ..... 312/263
GB 2030670 * 4/1980 ..... 312/263

* cited by examiner

*Primary Examiner*—Lanna Mai
*Assistant Examiner*—Hanh V. Tran
(74) *Attorney, Agent, or Firm*—James E. Brunton

(57) ABSTRACT

An improved, multifunction office furniture system having a novel interlocking connecting mechanism which permits the easy assembly of a variety of different structural components in a variety of different configurations to form highly efficient work areas. The system includes uniquely configured, vertical support columns to which a number of different types of structural components can be quickly and easily connected and provides a highly versatile work station system which is very attractive, is easy to assembly, disassemble and adjust, and yet, is structurally sound and durable in use. Because of its novel construction, the system is capable of readily accommodating changing work conditions in the users' facilities.

16 Claims, 10 Drawing Sheets

OFFICE FURNITURE SYSTEM

This a Continuation-In-Part of application U.S. Ser. No. 09/165,409 filed Oct. 2, 1998, now abandoned.

BACKGROUND OF THE INVENTION

1. Field of the Invention

The present invention relates generally to office furniture. More particularly, the invention concerns an improved, multifunction office furniture system having a novel interlocking connecting mechanism which permits the easy assembly of a variety of different structural components in a variety of different configurations to form highly efficient work areas.

2. Discussion of the Prior Art

Office furniture systems that exhibit superior structural characteristics and which exhibit flexibility and interchangeability among the parts to create multipurpose and multifunction work stations are in wide demand for many institutional applications. Entities having great need for such office systems include schools, hotels, business offices, and various governmental entities. Particularly in demand are flexible office systems that are easily altered to fit the work environment and meet the work requirements.

While many types of office systems have been suggested in the past, a typical drawback of such office systems is lack of flexibility to fit the space allowed for the work environment requiring the work environment to fit the office system. As a general rule, when the prior art furniture designers have attempted to overcome this limitation in prior art designs, such designs lack the structural strength and flexibilty to meet the work requirements.

The prior art systems typically use a variety of different arrangements to interconnect together desk tops, cabinets, files and other structural components to form variously configured work stations. Exemplary of a typical prior art adjustable desk system is that described in U.S. Pat. No 5,544,593 issued Canfield et. al. The Canfield patent discloses a basic superstructure that permits various cantilever supports to be connected thereto for supporting desk tops, pedestals and the like so that the various components can be adjusted relative to one another. The basic Canfield superstructure also permits back to back mounting of cabinets, desk tops and like components to provide separated work spaces.

Another prior art desk system is disclosed in U.S. Pat. No. 5,038,539 issued to Kelly et. al. This later patent describes a work space management system for dividing an open work space into separate, discrete work areas. The Kelly et al system includes a wall system having a framework formed of rigid rectangular frames joined together at their edges to form the defined work areas. The Kelly et al patent also discloses various wire management components which are secured to the frames for routing communication and power wiring.

A drawback of many of the prior art adjustable desk systems resides in the fact that the systems are generally quite complex, are often ergonomically unsound and, while often providing for adjustability of some components, fail to provide the overall convenience and flexibility required by modem computer intensive offices. In this connection, the constantly changing technology and the rapid emergence of computer networking systems have created an ever increasing demand for easily adaptable office furniture. Additionally, because of increases in repetitive stress injuries, there is a great demand for systems of the aforementioned character which offer ergonomic features that effectively guard against stress injury.

As will be discussed in detail in the paragraphs which follow, the desk system of the present invention overcomes many of the drawbacks of prior art systems by providing a system which is of a simple, ergonomically sound design and yet has great versatility. The system of the present invention is not only practical in use but provides an extremely attractive, structurally sound, freestanding work-area defining unit which is ideally suited for modem office complexes. The system is easy to assemble and disassemble by relatively unskilled workers and is uniquely designed to provide a safe and productive work environment.

SUMMARY OF THE INVENTION

It is an object of the present invention to provide a novel office system construction that is ideally suited for use in schools, hotels, business offices, and governmental offices, and similar commercial establishments.

Another object of the present invention is to provide a flexible construction for an office system that will permit the user to fit the office system to the work environment rather than fitting the work environment to the office system.

Another object of the invention is to provide a highly versatile work station system which is very attractive, is easy to assemble, disassemble and adjust, and yet, is structurally sound and durable in use.

Another object of the invention is to provide a system of the character described which is capable of readily accommodating changing work conditions in the users facilities.

Another object of the invention is to provide a fully adjustable, highly versatile work station system which includes a number of ergonomic features which provide a safe and productive work environment.

Another object of the invention is to provide a desk system which includes uniquely configured, vertical support columns to which a number of different types of structural components can be quickly and easily connected.

Another object of the invention is to provide a system of the character described in the preceding paragraph which is specially designed to eliminate under work surface obstacles.

Another object of the invention is to provide an adjustable desk system that includes a novel cable management systems which enables effective cable management within the structural components of the apparatus so that the cables are well protected from damage and yet are easily accessible so as to provide a wide range of electrical and communication capabilities.

Another object of the invention is to provide a desk system of the class described that is designed for ease and speed of installation and is readily adjustable into various configurations using a number of different types of readily interchangeable components.

DESCRIPTION OF THE INVENTION

Figure 1:
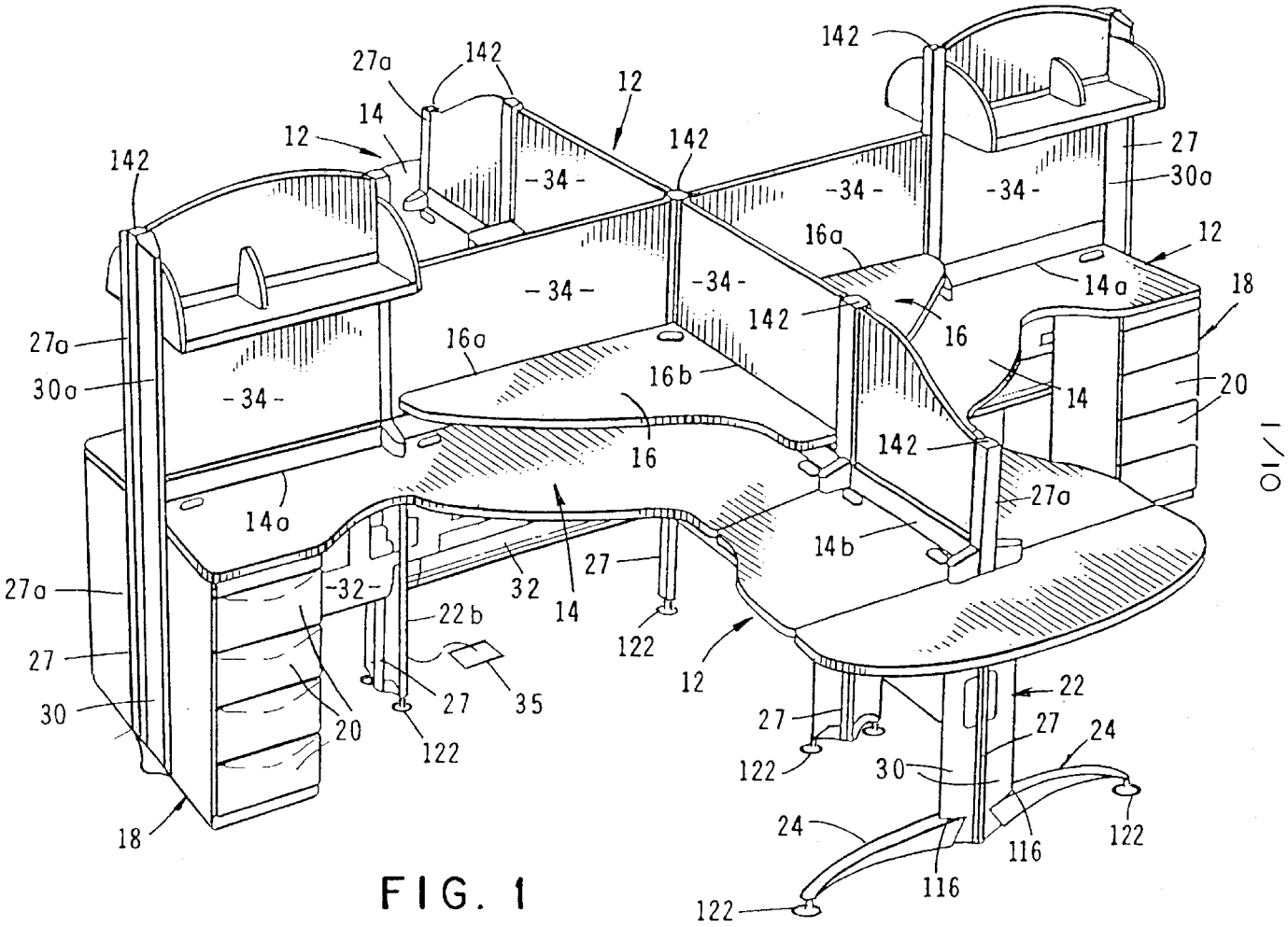
FIG. 1 is a generally perspective view of one form of the desk system of the present invention.

Referring to the drawings and particularly to FIGS. 1 through 8, one form of the desk system of the present invention is there illustrated. As best seen in FIG. 1, one embodiment of the desk system comprises four identical, individual work stations 12 which are interconnected in a back-to-back relationship to provide a free standing array. Each of the four work stations 12 includes a generally horizontally extending first work surface 14 and a second elevated work surface 16. The back edges 14*a* and 14*b* and 16*a* and 16*b* of each of the work surfaces 14 and 16 extend at right angles to one another and the front edges of each of the work surfaces are curved in the manner shown in FIG. 1 to permit ergonomically desirable access to the work surfaces by one or two persons using the work station.

One end of work surface 14 is supported by a storage unit 18 which includes a plurality of slidably mounted, stacked drawers 20. The other, or right edge of work surface 14 as viewed in FIG. 1 is supported by one of the novel leg assembly of the invention generally designated in FIG. 1 the numeral 22. This novel leg support assembly 22 includes a pair of outwardly extending, floor engaging stabilizer members 24 and a pair of wing-like side members 30 which are connected to central support 27 in a manner presently to be discussed.

A key aspect of the desk system of the present invention is the previously mentioned support member or column 27 which has the unique cross-sectional configuration shown in FIGS. 2 through 5 of the drawings. This novel support is used in several key locations in the system configuration shown in FIG. 1. For example, the central support column is used in the previously identified leg assembly 22, in a somewhat similar leg assembly 22*a* disposed at the left end of the work station as viewed in FIG. 1, and in an intermediate location where the leg assembly is designated as 22*b*. This highly novel support column not only functions to support the work surfaces of the system, but also functions to support plurality of laterally extending and longitudinally extending structural panels 32 which are disposed below the work surface 14. Additionally, the novel support columns support a plurality of longitudinally and laterally extending divider panels 34 which are disposed above the work surface. Divider panels 34 function to separate the four back-to-back work stations in the manner illustrated in FIG. 1.

Figure 6:
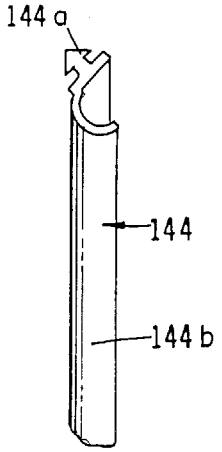
FIG. 6 is a generally perspective view of a closure shroud element which is receivable within radially outwardly extending grooves formed in each of the vertical support columns.

The lower structural panels 32, which are of a unique construction presently to be described, provide structural integrity to the array and extend generally perpendicularly outwardly from the walls of support columns 27 in the manner illustrated in FIGS. 1 and 6. For example, several lateral structural panels extend from column 27 of leg assembly 22, while several longitudinal structural panels extend from column 27 of leg assembly 22*a* (FIG. 1). Similarly, a lateral divider panel extends from an upper column segment 27*a* of leg assembly 22 while a longitudinal divider panel extends from an upper column segment 27*a* of leg assembly 22*a*. At least one of the longitudinally extending structural support panels, (designated in FIG. 8 by the numeral 33), comprises a wire management control panel. This novel wire support panel 33 includes a tray-like member 33*a* which functions to support and separate electrical cables and the like which can be connected to conventional floor outlet 35 and then introduced into the interior of a selected one or more of the support columns 27 and the structural panels 32*a*. The cables can also be connected to a ceiling outlet and run downwardly through stacked column segments.

Another novel feature of the desk system of the present invention comprises the column segment connector means which functions to connect together first and second lengths or segments of support columns 27. For example, as shown in FIG. 6, the previously identified lower support columns 27 can be interconnected with upper support columns designated in FIG. 6 as 27*a* to conveniently extend the overall height of the support column. For example, the novel segment connector means, the details of which will presently be described, can be used to securely interconnect lower segments 27 with upper segments 27*a* so that the upper segments 27*a* can rigidly support the longitudinally extending divider panels 34 in the manner indicated in FIGS. 1 and 8.

Figure 8:
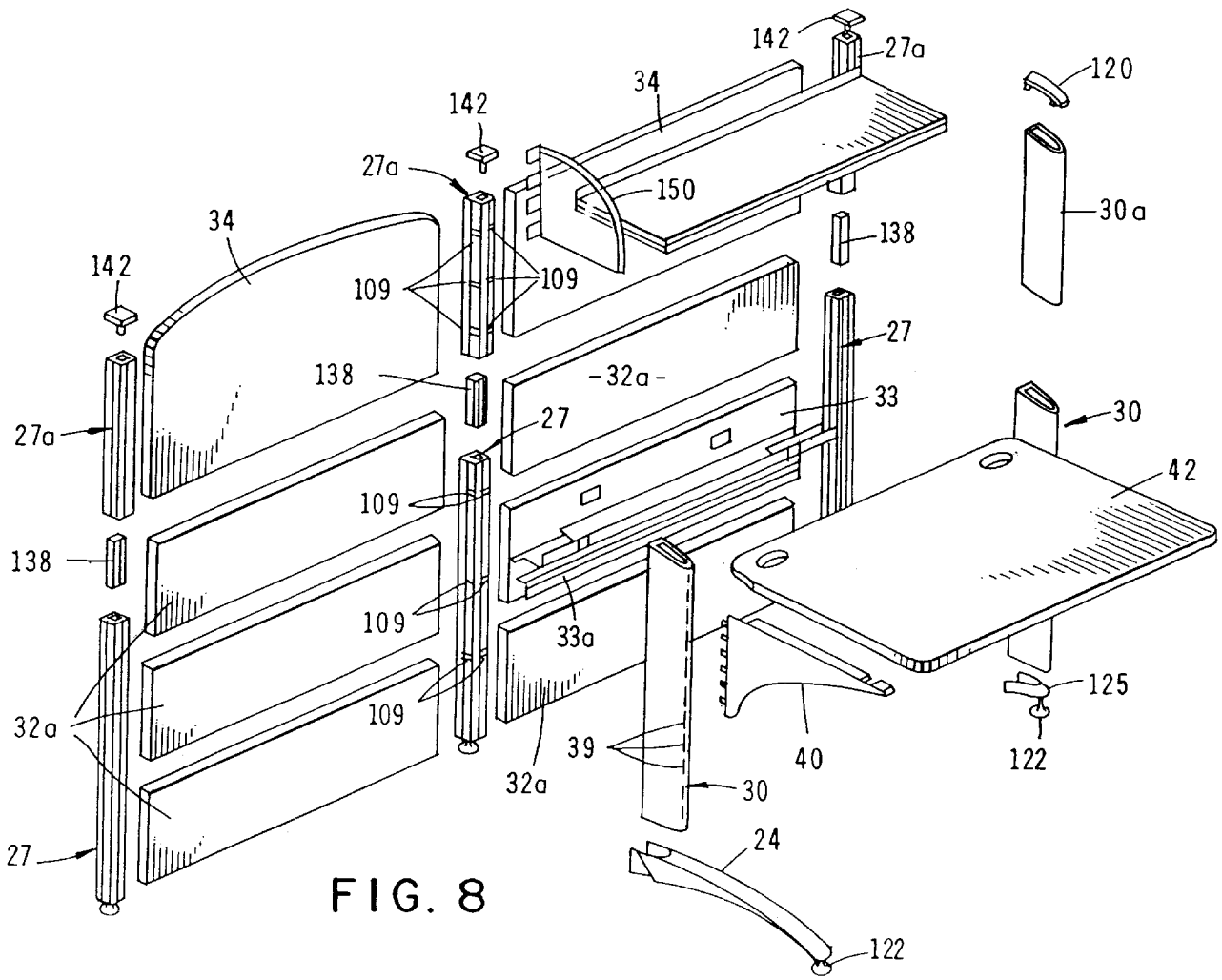
FIG. 8 is a generally perspective, exploded view illustrating the manner of interconnection of several of the different component parts of the desk system with longitudinally spaced apart vertical support columns of the character shown in FIGS. 2 through 5.

As also indicated in FIG. 8, certain of the wing-like, side members 30 can be provided with vertically spaced-apart slots 39 which are adapted to receive outwardly extending cantilever type support members 40 which can, where desired, function to support outward extending, auxiliary work surfaces such as the work surface identified in FIG. 8 by the numeral 42.

Figure 2:
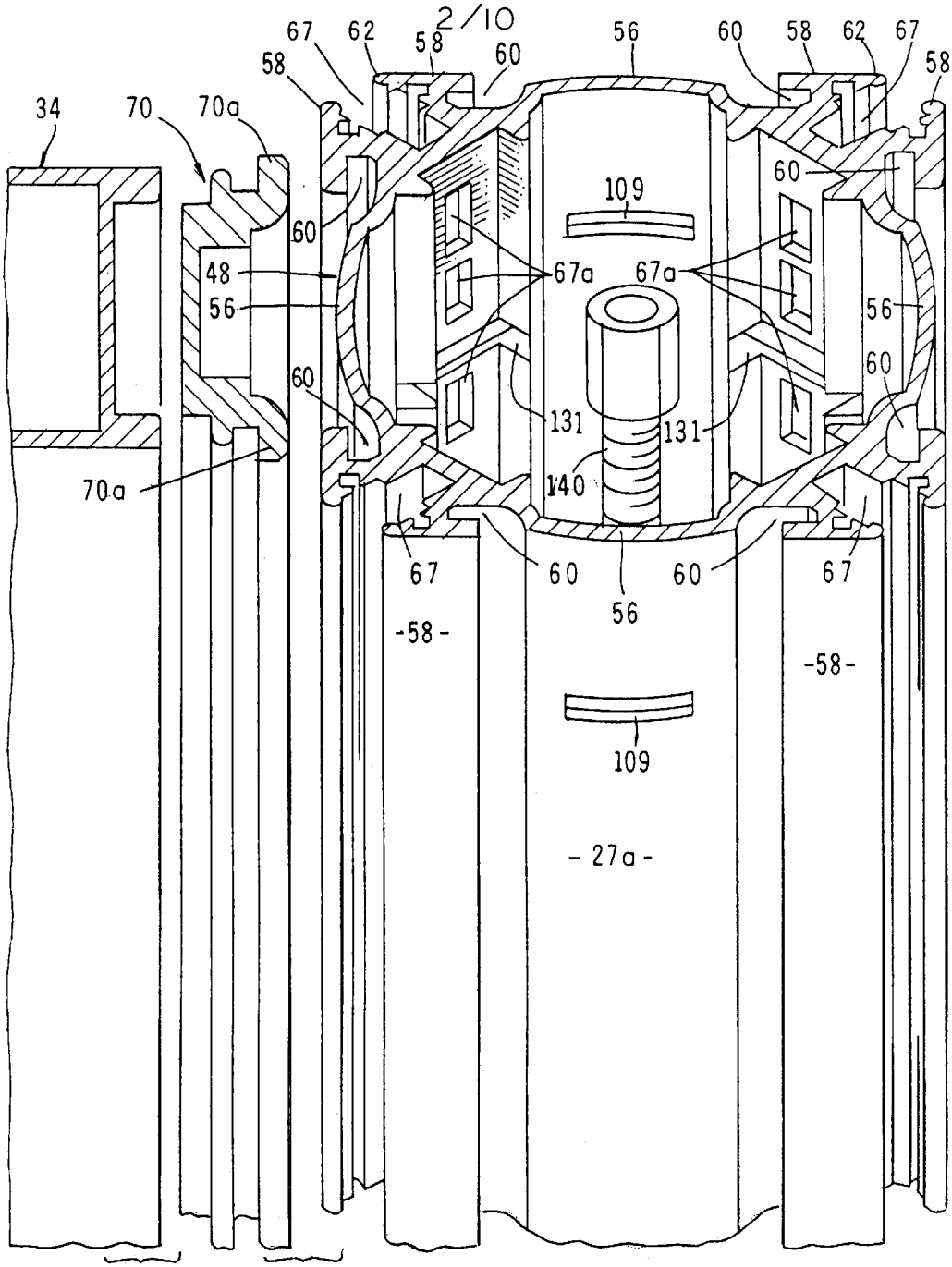
FIG. 2 is a generally perspective, exploded view illustrating the manner by which certain of the components, such as the divider panels of the system, are releasably interconnected with one of the novel vertical support columns of the apparatus.
Figure 3:
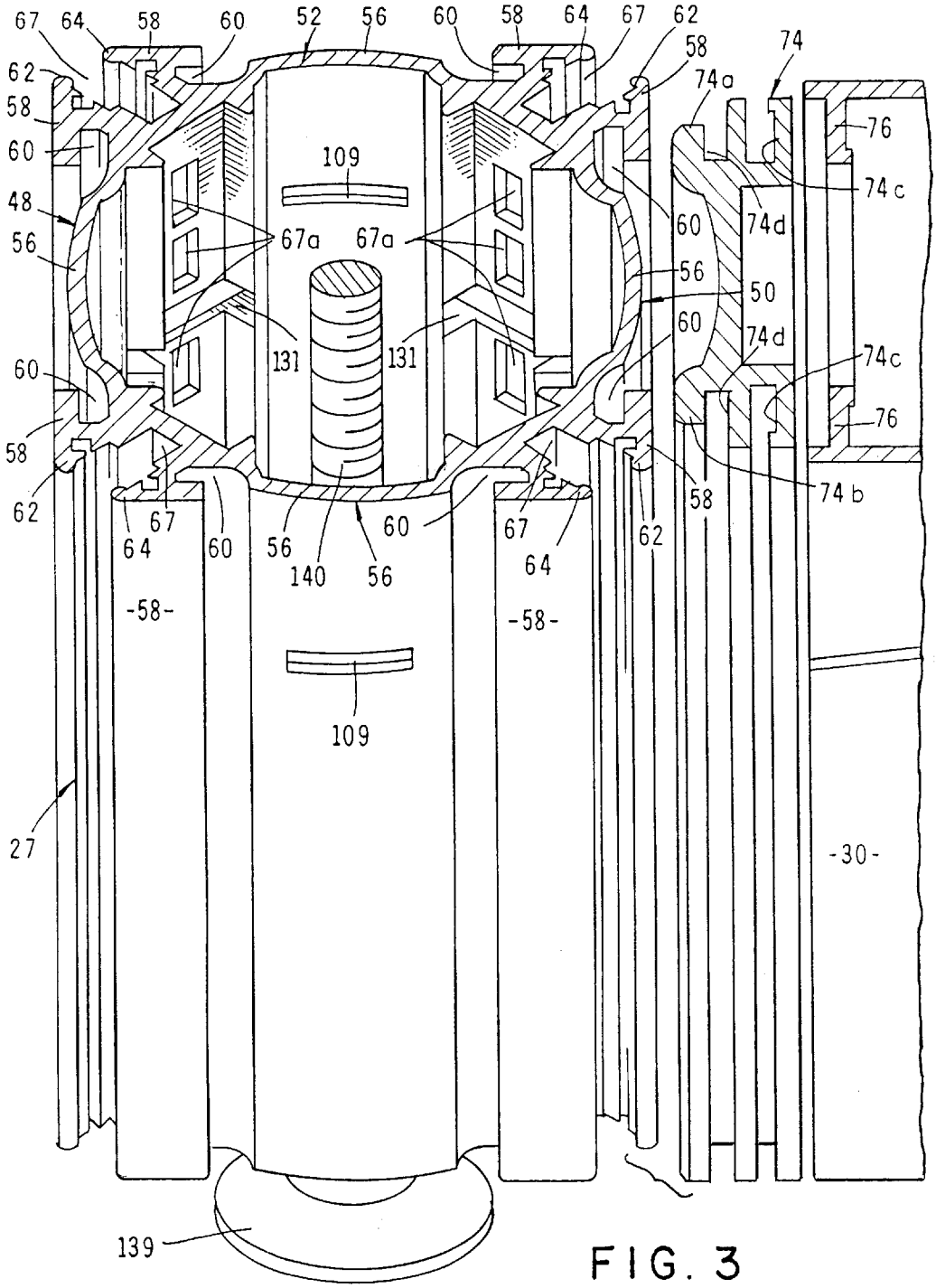
FIG. 3 is a generally perspective, exploded view similar to FIG. 2 illustrating the manner by which the outwardly extending side members of the leg assembly of the desk system are releasably interconnected with one of the novel vertical support columns of the apparatus.
Figure 4:
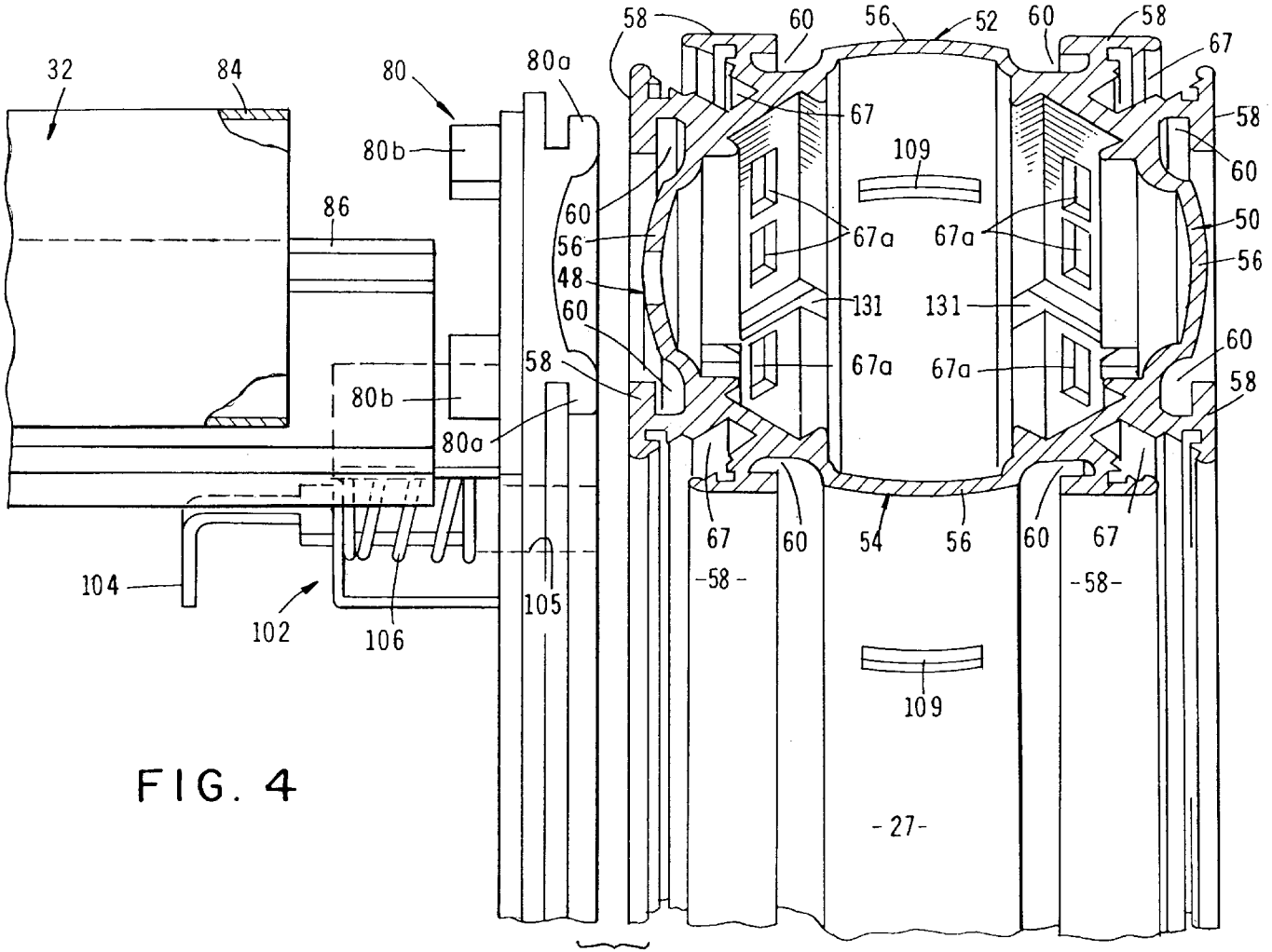
FIG. 4 is a generally perspective, exploded view similar to FIGS. 2 and 3 illustrating the manner of interconnection of the structural panels of the system with one of the novel vertical support columns of the apparatus.
Figure 5:
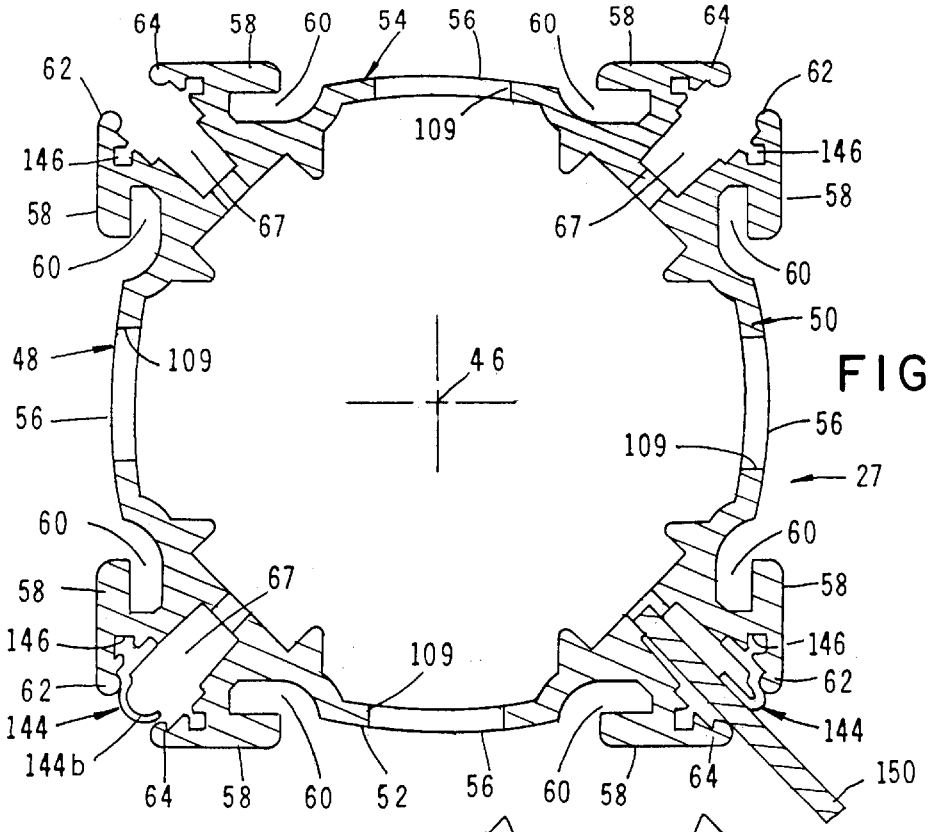
FIG. 5 is a cross-sectional view of one of the novel vertical support columns of the apparatus and a portion of one of the angularly extending attachment brackets that can be engaged into incremental notches formed in the corners of the support columns.

Turning next to FIGS. 2 through 5, the details of construction of the important central support members or columns 27 and 27*a* of the invention are there illustrated. As best seen in FIG. 5, each of the support members 27 has a central axis 46, first and second opposing side walls 48 and 50 respectively. Front and back walls 52 and 54 are integrally formed with or otherwise connected to side walls 48 and 50 in the manner best seen in FIG. 3. Each of the front, back and side walls includes a central portion 56 and first and second spaced-apart marginal portions 58. Disposed between the central portions and the marginal portions of each of the walls are first and second generally coplanar grooves generally designated in the drawings by the numeral 60. Each of the marginal portions 58 of each of the side walls 48 and 50 includes a first edge 62. Similarly, each of the marginal portions 58 of each of the front and back walls 54 and 56 includes a second edge 64 (FIG. 3). Disposed between each of the edges 62 and 64 is a corner groove 67 which extends generally radially outwardly from central axis 46 of the support column. These radially outwardly extending grooves 67 are closed by back walls which are provided with spaced-apart slots 67*a* (FIG. 2). Slots 67*a* are adapted to receive engagement fingers 150*a* of cantilevered supports 150 which are of the same general character as those shown in FIG. 8 and can be used to support auxiliary work surfaces such as shelves.

A unique feature of the desk system of the present invention resides in the fact that each of the components which is interconnected with the columns 27 includes a specially configured connector strip which is provided with a pair of spaced-apart tongues that are slidably receivable within grooves 60 provided in each of the support column segments 27 and 27*a*. This novel feature permits the various components of the desk system to be quickly and easily interconnected with and removed from the various spaced-apart support columns 27 which provide vertical support to the components of the assembled array. More particularly, as can best be seen by referring to FIG. 2, each of the divider panels 34 includes a uniquely configured connector member 70 which is provided with spaced-apart tongues 70*a*. As indicated in FIG. 2, tongues 70*a* are slidably receivable within selected grooves 60 provided in the support column 27*a*. As indicated in FIG. 2, connector member 70 is, in turn, adapted to be interconnected along its length with a selected divider panel 34 by any suitable means such as threaded connector or the like. It is apparent that with this construction, selected panels 34 can be quickly and easily removably interconnected with any one of the support columns 27*a* to construct the arrays shown in FIGS. 1 and 8.

Figure 12:
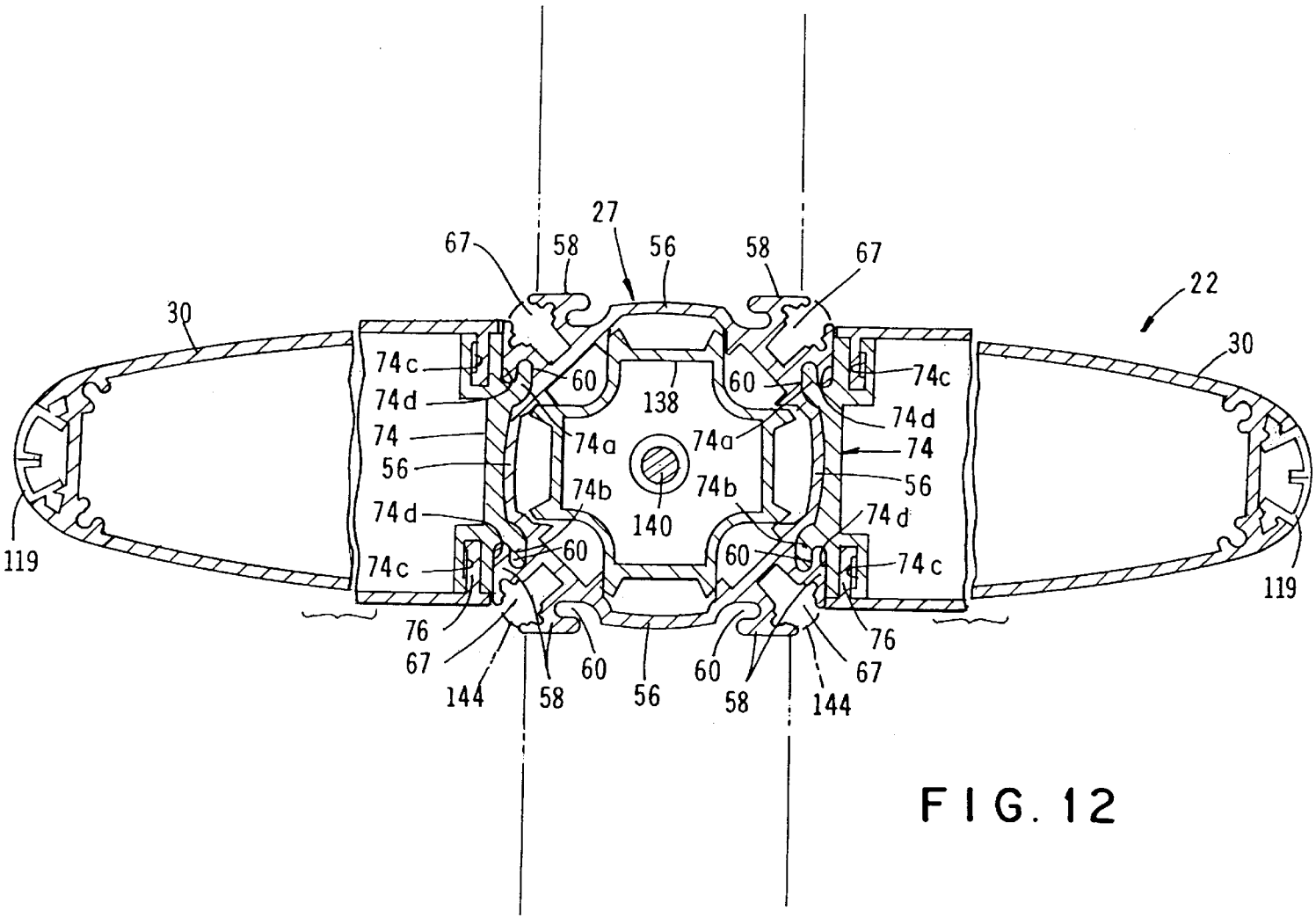
FIG. 12 is an enlarged, cross-sectional view showing the wing-like sides of the leg assembly interconnected with one of the vertical support columns and also illustrating the column segment connector means of the invention including the stiffener element shown in FIG. 7 which is disposed internally of the vertical support column

Referring particularly to FIGS. 3 and 12, it is to be noted that each of the wing-like side members 30 which form the previously identified leg assemblies 22, 22*a* and 22*b* include a specially configured connector member 74 which includes spaced-apart substantially coplanar tongues 74*a* and 74*b* which are slidably receivable within substantially coplanar grooves 60 provided in the support column 27 shown in FIG. 3. In this latter case, connector member 74 is also provided with a pair of grooves 74*b* which slidably accept spaced-apart tongues 76 formed proximate the in-board ends of wing-like members 30. Connector member 74 further includes a pair of substantially coplanar grooves 74*c* which are disposed proximate tongues 74*a* and 74*b* and are constructed and arranged to receive marginal portions 58 of the side walls (FIG. 12).

Figure 10:
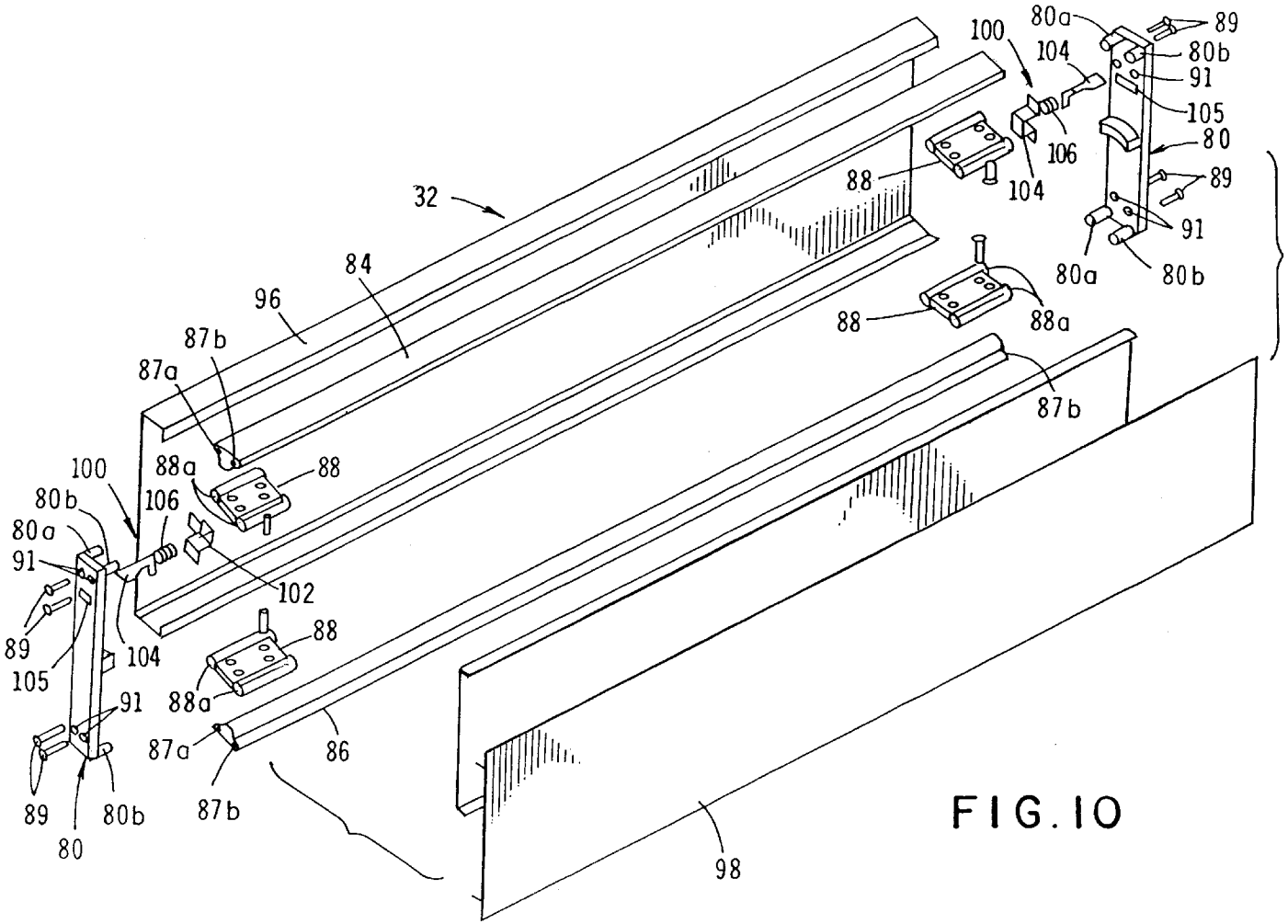
FIG. 10 is a generally perspective, exploded view of one form of the structural panel of the desk system.

Turning to FIGS. 4 and 10, it can be seen that, in similar fashion, each of the structural panels 32 and 33 of the invention include novel end plates 80, each of which is provided with a pair of spaced-apart tongues 80*a* which are slidably receivable within grooves 60 formed in the side walls 48 and 50 of the various spaced-apart support columns which are spanned by the structural support panels 32 in the manner shown in FIG. 8. Once again, it is apparent that with the novel construction of the structural panels as is shown in FIGS. 4, 6, and 10, the panels can be readily interconnected with spaced-apart support columns 27 in the manner shown in FIG. 8 to provide a high degree of structural integrity to the desk system arrays shown in FIGS. 1 and 8. It is also to be understood that the wire management panels such as panel 33 also includes connector members 80 provided at each end thereof which connector members are also slidably receivable within grooves 60 provided in the spaced-apart support columns which function to support the wire management panels.

Referring particularly to FIGS. 4 and 10, each of the structural panels 32 can be seen to comprise, in addition to end connector assemblies 80, first and second uniquely configured structural beams 84 and 86 which are connected to and span spaced-apart end connectors 80. Structural beams 84 and 86 are generally mushroom shaped in cross-section so as to resist bending forces exerted on the members and each includes laterally spaced-apart, tab-receiving openings 87*a* and 87*b* (FIG. 10). Openings 87*a* and 87*b* are adapted to closely telescopically receive tab-like protuberances 80*a* and 80*b* formed proximate the upper and lower ends of each connector member 80.

Connected proximate to each end of beams 84 are 86 are connector blocks 88, each of which has spaced-apart screw receiving openings 88*a* which are sized to receive connector means shown here as a plurality of thread forming metal screws 89 (FIG. 10). Thread forming metal screws 89 extend through openings 91 formed in each of the end plates 80 and are theadably received within the screw receiving channels 88*a* formed in connector blocks 88. With the construction thus described, when tabs 80*a* and 80*b* of end connectors 80 are inserted into openings 87*a*, and 87*b*, provided in each of the structural beams 84, the assemblage thus formed can be securely drawn together and locked in position relative to the end plates by threading the thread forming screws 89 into the screw receiving channels 88*a* provided in each of the connector blocks 88. It is to be understood that rivets can also be used as connectors to connect blocks 88 to end plates 80. After the end connectors 80 have been securely interconnected with the structural beams and the connector blocks, the assemblage thus formed is covered by first and second side closure panels 96 and 98 so as to enclose therebetween the spanner members and the connector blocks.

Also forming a part of each of the structural panels 32 are locking means for locking the end connectors 80 in a fixed position relative to the structural supports 27 from which they extend in the manner shown in FIG. 8. These locking means are here provided in the form of a spring loaded locking mechanism 100 which comprises a supporting bracket 102 which is connected to connectors 80, and a spring biased locking finger 104 which is carried by a bracket. Locking finger 104 is continuously biased outwardly through a slot 105 formed in the connector body by biasing means, shown here as coil spring 106 (see also FIG. 4). With this construction, when the end plates 80 are assembled with a selected support column 27, locking finger will snap into engagement with one of a plurality of slit like openings 109 formed in all four walls of the vertical support column segments 27 and 27*a* (FIGS. 2 and 8).

Figure 9:
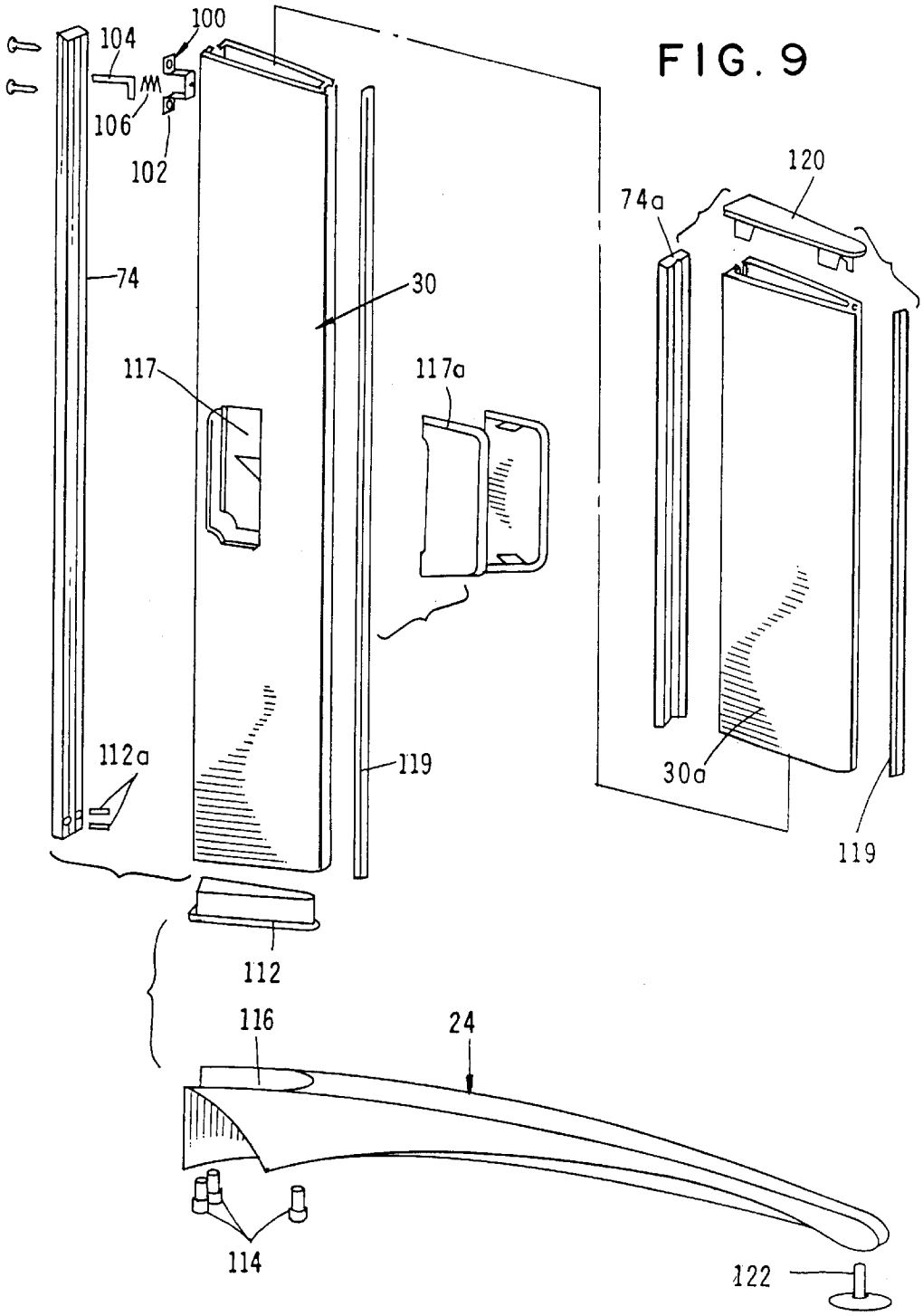
FIG. 9 is a generally perspective, exploded view illustrating the manner of interconnection of the wing-like side members of the leg assemblies and the floor engaging, stabilizing members of the leg assembly with an elongated connector element that permits interconnection of the leg assemblies with a selected one of the vertical support columns of the invention.

It is to be understood that the locking means of the invention can also be disposed internally of leg assembly side members 30 and can function to position the side members relative to the support columns 27 with which they are associated (see for example FIG. 9).

Turning to FIG. 9, it can be seen that side members 30 are interconnected with the previously identified elongated connector member 74 with the locking means of the invention, or mechanisms 100 being interconnected to the interface of connector 74. Receivable within the lower open end of side member 30 is a connector block 112 which enables interconnection of the stabilizer members 24 with side members 30 by means of threaded connectors 114 which are threadably received within block 112. More particularly, connector block 112 is telescopically received within the lower open end of the side members 30 and is held in position by fasteners 112*a* which extend through connector member 74 and function to connect connector block 112 with connector member 74 and member 30. The assemblage thus formed is then connected with the stabilizer member 24 in the manner previously described. Cavity 116 includes a bottom wall which receives threaded connectors 114 so that when the connectors are threadably interconnected with connector block 112, the assemblage made up of side member 30 and connector 74 will be securely locked in position relative to stabilizer member 24 to form a stable, securely interconnected subassembly. In the leg assemblage illustrated in FIG. 9, the side member 30 is provided with a cable receiving opening 117 which permits convenient cable routing into the wire management structural panels. Openings 117 can be closed by removable closure panels 117*a*. Similarly, the outboard ends of members 30 and 30*a* can be closed by elongated closure strips 119.

In the desk system construction illustrated in FIG. 1, upper side members 30*a* are connected to lower side members 30 in the manner there shown and function to provide structural stability to the upper portions of the array. Providing further structural stability are the divider panels 34 which are disposed proximate the right and left ends of the array as viewed in FIG. 1. As shown in FIG. 9, side members 30*a* are interconnected with vertical support column 27*a* by means of an elongated connector member 74*a* which is of a construction similar to that of connector 74. The upper open end of side members 34*a* are preferably closed by a plastic closure cap 120 of the general configuration shown in FIG. 9.

When desired, floor engaging castors 122 can be connected to stabilizer 24 in the manner indicated in FIG. 9 (see also FIG. 1). When desired, similar castors 122 can be connected directly to side members 30 in the manner shown in FIG. 1. In this latter instance, a connector bracket 125, to which the castor is threadably connected is connected to side members 30.

Figure 11:
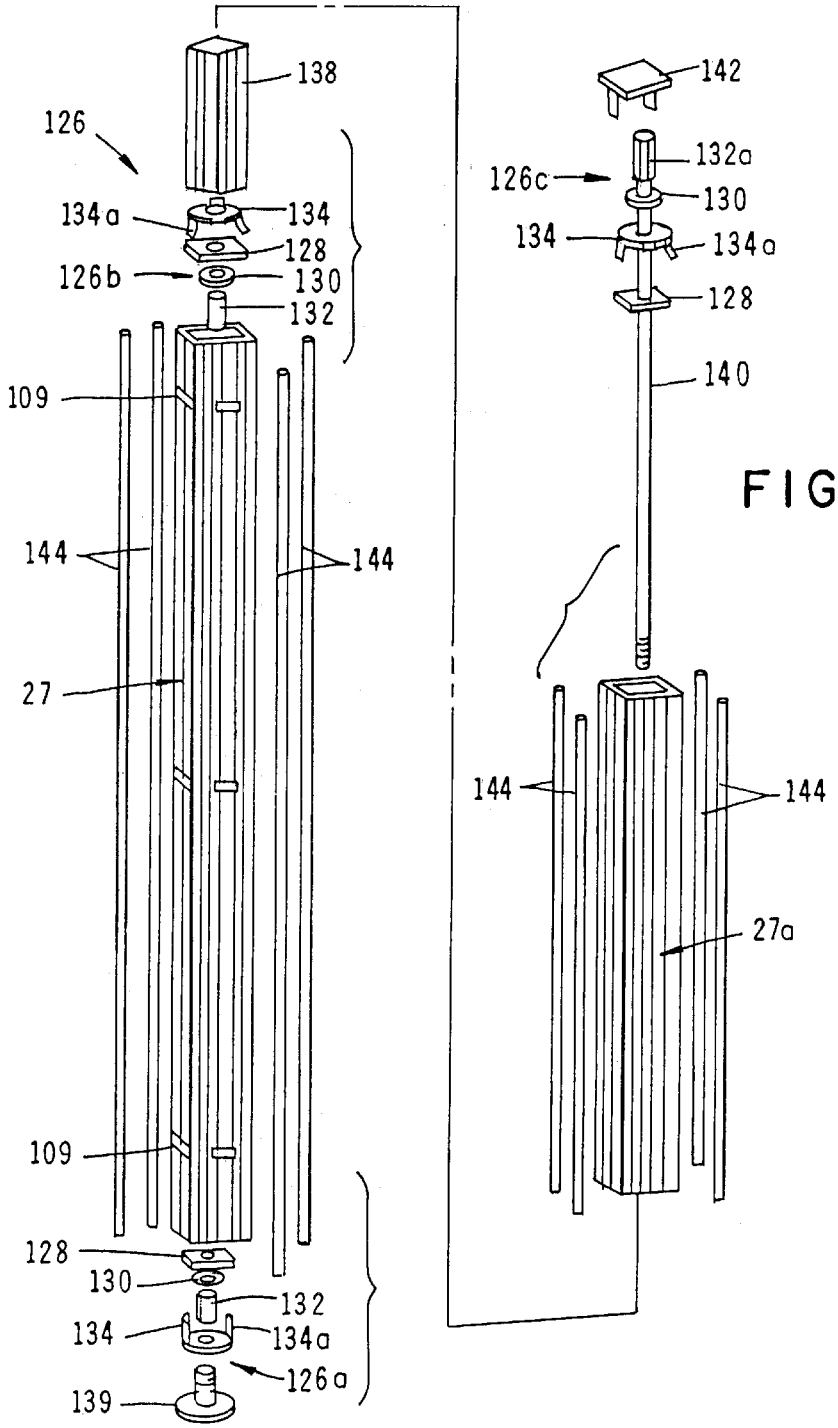
FIG. 11 is a generally perspective, exploded view of one form of the connector means of the invention which is used to interconnect first and second lengths or segments of the vertical support columns.

Turning next to FIGS. 11 and 12, the details of the construction of the previously identified segment connector means of the invention can there be seen. In the present form of the invention, the segment connector means comprise a plurality of spaced-apart connector assemblies 126. Each of the side connector assemblies comprise a bearing plate 128 having corner portions which are cammingly received within internal grooves 131 formed in supports 27 (FIG. 2). Each assembly also includes a washer 130, a self-clinching nut 132, and a plate lock 134. A first connector assemblage 126*a* is secured internally of support columns 27 proximate the lower extremities thereof. And a second threaded connector element assembly 126*b* is disposed within support columns 27 proximate their upper extremities (FIG. 11). The assemblies are held securely in position within the support columns by the bearing plates 128 which, when rotated within columns 27 will cam into grooves 131. The resiliently deformable, outwardly extending wing-like tabs 134*a* formed on the plate locks 134 bite into the interior walls of the support columns 27 and prevent the bearing plates 128 from counter-rotating out of grooves 131 once the connector assembly is in position. In similar fashion, a connector assembly 126*c* is disposed within the upper portion of the column segment 27*a*. Connector assembly 126*c* is similar in construction to assemblies 126*a* and 126*b*. However, the self-clinching nut 132 has been replaced with an internally threaded coupling nut 132*a* which allows for further extension of the support columns as may be necessary.

Figure 7:
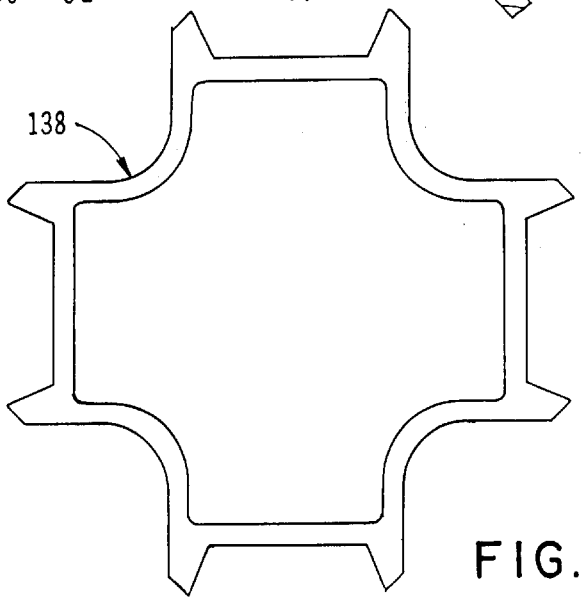
FIG. 7 is a cross-sectional view of a stiffener element of the character used to interconnect together two or more lengths of the support columns of the invention.

Also forming a part of the connector means of the invention is a uniquely configured stiffener member 138 which is telescopically received within the upper portion of support column 27 and within the lower portion of support column 27*a*. The configuration of this stiffener member, which is of the character shown in FIG. 7, provides a substantial reinforcement against and tendency column segment 27*a* may have to bend relative to column segment 27. As best seen in right-hand portion of FIG. 11, connector assemblies 126*b* and 126*c* are interconnected by an elongated, externally threaded tie rod 140 which extends interiorly of stiffener member 138. Where desired, a castor 144 can be connected to connector assembly 126*a* in the manner shown in the lower right-hand portion of FIG. 11. If desired, a tie rod 140 can be used to interconnect connector assemblies 126*a* and 126*b* (see FIG. 12). To close the open upper ends of support columns, plastic closure caps 142 such as are shown in FIGS. 1 and 9 are used.

Turning once again to FIG. 7, it is to be noted radially outwardly extending grooves 67 formed in each of the vertical support columns 27 and 27*a* is closed by a closure shroud 144 which is of the unique configuration shown in FIG. 6. Each of the shrouds 144 is provided with a longitudinally extending, generally arrow-shaped protuberance 144*a* which is receivable within a similarly shaped cavity 146 formed at each corner of the support columns 27 and 27*a* (FIG. 5). Each shroud 144 also has a yieldably deformable curved wall portion 144*b* which functions to close each of the radially extending grooves 67 in the manner best seen in FIG. 5. With this novel construction, cantilever supports, such as supports 150 (FIGS. 7 and 8), can be inserted into a selected radially extending groove 67 by deforming the shroud member 144 in the manner shown in the lower right-hand portion of FIG. 7.

Having now described the invention in detail in accordance with the requirements of the patent statutes, those skilled in this art will have no difficulty in making changes and modifications in the individual parts of their relative assembly in order to meet specific requirements or conditions. Such changes and modifications may be made without departing from the scope and spirit of the invention, as set forth in the following claims.

We claim:

1. A desk system comprising:

(a) a central support generally octagonal shaped in cross section anti having a central axis; First and second opposing side walls; a front wall connected to said first and second side walls by connecting walls and a back wall connected to said first and second side walls by connecting walls, each of said front, back and side walls including:

(i) a curved central portion;

(ii) first and second spaced apart marginal portions; and (iii) first and second grooves disposed between said central portion and said marginal portion; and (b) a connector member connected to and extending from a selected one of said first and second opposing side walls, said connector member having a recessed central area which receives and supportably engages a substantial portion of said curved central portion of said selected one of said first and second opposing side walls and a pair of spaced-apart, substantially coplanar tongues slidably receivable within said first and second grooves provided in the selected side wall.

2. A desk system as defined in claim 1, further including a first longitudinal support connected to and extending from a selected one of said front and back walls, said longitudinal support having a pair of spaced apart tongues slidably receivable within said first and second grooves provided in said selected front and back wall.

3. A system as defined in claim 1 in which each of the said marginal portions of said side walls extend substantially perpendicular to said marginal portions of said front and back walls.

4. A system as defined in claim 1 in which each of said marginal portions of said side walls includes a first edge and in which each of said marginal portions of each of said front and back walls includes a second edge, said first edges being spaced apart from said second edges to define corner grooves.

5. A system as defined in claim 4 in which said corner grooves extend radially outwardly from said central axis of said support.

6. A system as defined in claim 4 in which said central support includes first and second interconnected segments.

7. A system as defined in claim 6 in which said support is generally tubular shaped and in which said system further includes segment connector means for connecting together said first and second segments.

8. A system as defined in claim 7 in which said segment connector means are disposed interiorly of said tubular support.

9. A desk system comprising:

(a) a central support having a central axis; first and second opposing side walls; a front wall connected to said first and second side walls by connecting walls and a hack wall connected to said first and second side walls by connecting walls, each of said front, side and hack walls including:

(i) a curved central portion;

(ii) first and second spaced-apart marginal portions; and (iii) first and second grooves disposed between said central portion and said marginal portion; and (b) a connector member connected to and extending from each of said first and second opposing side walls, each said connector member having a recessed central urea which receives and supportably engages a substantial portion of said curved central portion of each of said first and second opposing side walls and a pair of spaced-apart substantially coplanar tongues slidably receivable within said first and second grooves provided in the selected side wall and a pair of spaced apart grooves disposed proximate said pair of spaced-apart tongues, said marginal portions being receivable within said grooves of said connector member.

10. A desk system as defined in claim 9 in which each of said connecting portions is provided with a plurality of spaced-apart slots.

11. A desk system as defined in claim 9 further including a side member connected to and extending from said connector member.

12. A desk system comprising:

(a) a central support, generally octagonal in shape in cross section and having a central axis; first and second opposing side walls, each said side wall having a curved central portion, first and second grooves and marginal portions spaced apart from said central portion and spaced apart from said grooves and including a first edge; a front wall connected to said first and second side walls by connecting walls, and a back wall connected to said first and second side walls by connecting walls, each of said front and back walls having a curved central portion, first and second grooves and marginal portions spaced apart from said central portion and spaced apart from said grooves and including a second edge, said first and second edges being spaced apart to define corner grooves;

(b) a connector member connected to and extending from each of said first and second opposing side walls, said connector member having a recessed central area which receives and supportably engages a substantial portion of said curved central portion of each of said opposing side walls and a pair of spaced apart substantially coplanar tongues slidably receivable within said first and second grooves provided in the selected side wall and a pair of spaced apart grooves disposed proximate said pair of spaced-apart tongues, said marginal portions being receivable within said grooves of said connector member.

13. A desk system as defined in claim 12 in which said central portion of each of said side walls, said front wall and said back wall is curved.

14. A desk system as defined in claim 12 in which each of said connecting portions are provided with a plurality of spaced-apart slots.

15. A desk system as defined in claim 14 including at least one support receivable within a selected one of said corner grooves.

16. A desk system as defined in claim 15 in which said at least one support has fingers receivable within said spaced-apart slots.

* * * * *